US007337641B1

(12) United States Patent
Bruggemann

(10) Patent No.: US 7,337,641 B1
(45) Date of Patent: Mar. 4, 2008

(54) HYDROFORMED TUBULAR MEMBERS AND METHOD OF HYDROFORMING TUBULAR MEMBERS FOR VEHICLES

(75) Inventor: Charles J. Bruggemann, Rochester Hills, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/554,227

(22) Filed: Oct. 30, 2006

(51) Int. Cl.
*B21D 39/08* (2006.01)
*B21D 26/02* (2006.01)

(52) U.S. Cl. ..... 72/58; 72/61; 72/622

(58) Field of Classification Search ..... 72/56, 72/57, 58, 61, 62
See application file for complete search history.

(56) References Cited

U.S. PATENT DOCUMENTS

| | | | | |
|---|---|---|---|---|
| 2,203,868 | A * | 6/1940 | Gray et al. | 72/58 |
| 2,238,037 | A * | 4/1941 | Cornell, Jr. | 72/58 |
| 5,765,420 | A * | 6/1998 | Schaefer | 72/58 |
| 6,029,487 | A * | 2/2000 | Genin et al. | 72/58 |
| 6,202,460 | B1 * | 3/2001 | Gardon | 72/58 |
| 6,282,934 | B1 * | 9/2001 | Bikert et al. | 72/58 |

* cited by examiner

*Primary Examiner*—David B Jones

(57) ABSTRACT

A hydroformed tubular member and method of hydroforming the hydroformed tubular member for a vehicle includes the steps of providing a tubular blank and positioning the tubular blank within a die. The method also includes the steps of hydroforming the tubular blank in the die into a tubular member having a generally "T" shape with a sidewall having a straight length of the sidewall increased from its originally expanded length.

2 Claims, 2 Drawing Sheets

FIG 1
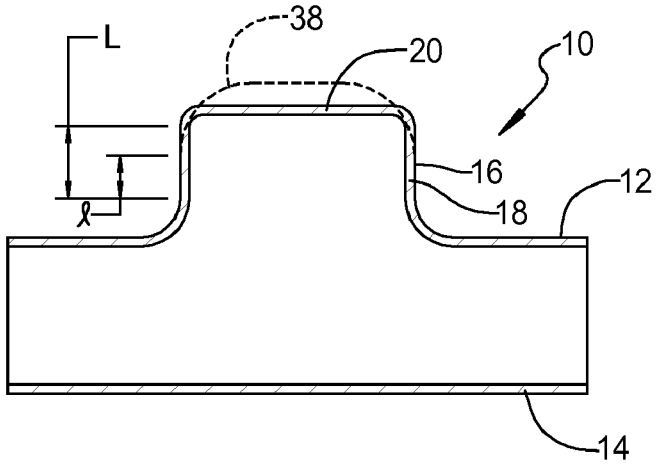
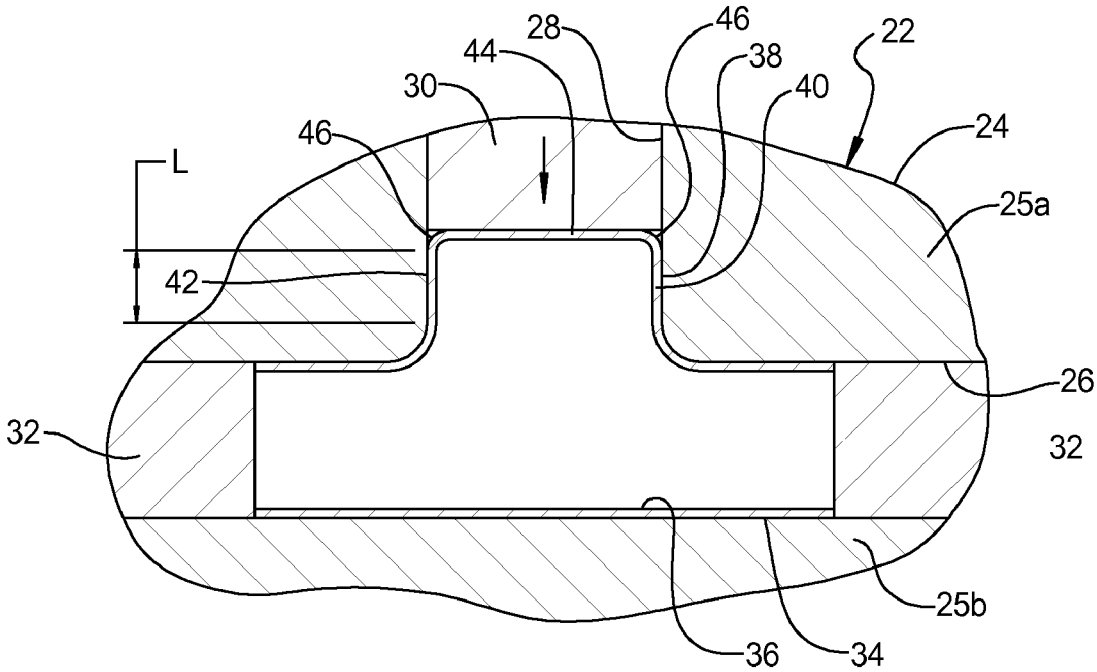
FIG 5

HYDROFORMED TUBULAR MEMBERS AND METHOD OF HYDROFORMING TUBULAR MEMBERS FOR VEHICLES

TECHNICAL FIELD

The present invention relates generally to vehicles and, more specifically, to a hydroformed tubular member and a method of hydroforming a tubular member for a vehicle.

BACKGROUND OF THE INVENTION

It is known to construct tubular members for vehicles such as automotive vehicles. The tubular members are typically extruded from aluminum or magnesium and have a constant wall thickness. However, it is occasionally desirable to have a tubular member that has an increased stiffness, wherein the stiffness is increased away from the ends of the tubular member.

It is known to hydroform tubular components or members. Hydroformed tubular members are becoming increasingly popular in automotive body structural applications. During vehicle body manufacturing, many of the hydroformed tubular members are used in vehicle body and chassis applications. However, vehicle strength, stiffness, and/or impactworthiness often necessitate the need for local areas of structural reinforcement to meet their design goals.

It is further known to make "T" fittings such as for plumbing tube connectors using an axial feed hydroforming process. In this process, a die is constructed to have two opposing end seals and a piston situated in a center and perpendicular to the straight cylindrical cavity of the die. A straight tubular member is placed in the die. The die is closed and the ends seals are brought into contact with the ends of the tubular member. Fluid is filled into the tubular member. The hydroforming process proceeds by progressively increasing the internal fluid pressure in the tubular member while the end seals are pushed toward one another, compressing the tubular member axially. Concurrent with the end seals moving toward each other, the central piston, which was initially flush with the die cavity wall, is progressively retracted to allow a sidewall of the tubular member to bulge into a shaft of the piston and create a "T" shape of the T fitting. The resulting hydroformed dome of the T fitting will have a portion of its sidewall that is straight and of length in contact with the shaft of the central piston. However, there are circumstances in which the requirements for length of the straight side of the hydroformed dome of the "T" fitting is inadequate for sufficient overlap of an attaching tubular member to produce a reliable lap weld condition.

As a result, it is desirable to provide a method of increasing a straight sidewall of a dome on a T fitting. It is also desirable to provide a hydroformed "T" shaped tubular member having sufficient overlap for an attaching tubular member to produce a reliable lap weld condition. Therefore, there is a need in the art to provide a new hydroformed tubular member and cost effective method that meets at least one of these desires.

SUMMARY OF THE INVENTION

Accordingly, the present invention is a method of hydroforming a hydroformed tubular member for a vehicle. The method includes the steps of providing a tubular blank and positioning the tubular blank within a die. The method also includes the steps of hydroforming the tubular blank in the die into a tubular member having a generally "T" shape with a sidewall having a straight length of the sidewall increased from its originally expanded length.

Additionally, the present invention is a hydroformed tubular member for a vehicle including a first portion extending axially and a second portion extending outwardly from the first portion and being generally perpendicular thereto. The second portion has a sidewall having a straight length increased from its originally expanded length.

BRIEF DESCRIPTION OF THE DRAWINGS

FIG. 1 is a fragmentary elevational view of a hydroformed tubular member made by a method, according to the present invention, for hydroforming a tubular member.

FIG. 5 is a view similar to FIG. 2 illustrating a third step of the method for hydroforming the hydroformed tubular member of FIG. 1.

DESCRIPTION OF THE PREFERRED EMBODIMENT

Figure 2:
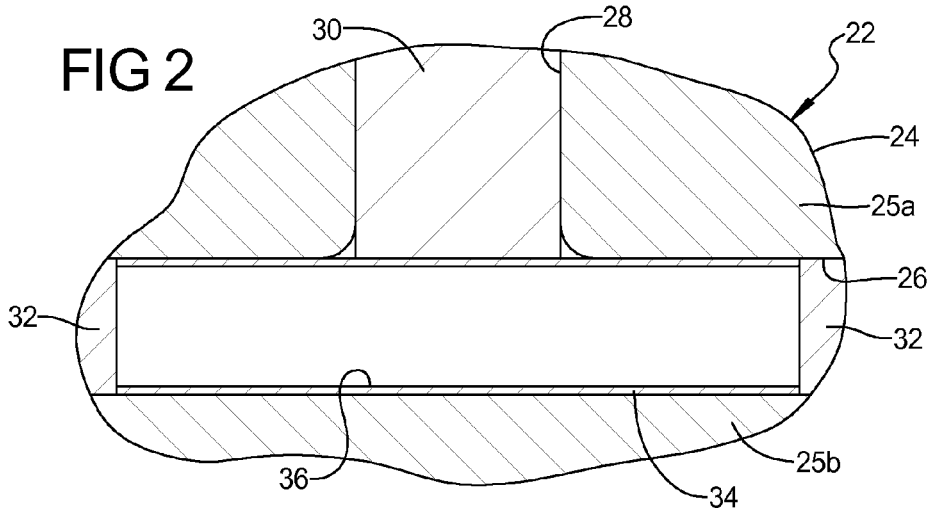
FIG. 2 is a fragmentary elevational view of an apparatus for hydroforming the hydroformed tubular member of FIG. 1.

Referring to the drawings and in particular FIG. 1, one embodiment of a hydroformed tubular member 10, according to the present invention, is generally shown for a vehicle (not shown). In the embodiment illustrated in FIG. 1, the hydroformed tubular member 10 is generally "T" shaped. The hydroformed tubular member 10 is a tube having a generally circular cross-sectional shape. The hydroformed tubular member 10 has a first portion 12 extending axially. The first portion 12 has a generally arcuate shaped wall 14 forming a closed perimeter. The hydroformed tubular member 10 has a second portion 16 extending outwardly and generally perpendicular to the first portion 12. The second portion 16 is centrally located between the axial ends of the first portion 12. The second portion 16 has a wall 18 forming a closed perimeter. The wall 18 has a length (l) less than a length (L) of the originally expanded second portion 16. The second portion 16 has an end wall 20 closing the end of the second portion 16. The hydroformed tubular member 10 is made of a metal material with good elongation properties such as mild steel or aluminum. The hydroformed tubular member 10 is formed by an apparatus and method to be described. It should be appreciated that the hydroformed tubular member 10 is a monolithic structure being integral, unitary, and one-piece. It should also be appreciated that the hydroformed tubular member 10 may be defined as having a closed circular cross-section.

Referring to FIG. 2, one embodiment of an apparatus 22, according to the present invention, is shown for hydroforming the hydroformed tubular member 10. The apparatus 22 includes a die, generally indicated at 24, comprised of an upper die half 25*a* and a lower die half 25*b*. The die 24 has a first cavity 26 extending axially into the die halves 25*a* and 25*b* and a second cavity 28 extending generally perpendicular into the upper die half 25*a*. The second cavity 28 communicates with the first cavity 26. The apparatus 22 also includes a movable piston 30 disposed within the second cavity 28. The piston 30 is generally cylindrical in shape with a generally circular cross-sectional shape. The apparatus 22 further includes at least one, preferably a pair of movable end seals 32 disposed within the first cavity 26. Each end seal 32 is generally cylindrical in shape with a generally circular cross-sectional shape. It should be appreciated that the piston 30 and end seals 32 are movable relative to the die 24.

Referring to FIG. 2, one embodiment of a method, according to the present invention, of hydroforming the hydroformed tubular member 10 is shown for assembly in automotive structures (not shown) of a vehicle (not shown). The method includes the step of providing a metal tubular member or blank 34. In this embodiment, the tubular blank 34 is a circular tube having a wall 36 with a uniform wall thickness.

The method also includes the step of disposing the tubular blank 34 in the first cavity 26 of the die 24 and centering the tubular blank 34 in the first cavity 26 such that the piston 30 is generally centered over and between the axial ends of the tubular blank 34.

The method includes the step of closing the die halves 25*a* and 25*b* upon one another with the tubular blank 34 being tightly clamped between the die halves 25*a* and 25*b*. The method also includes the step of sealing the axial ends of the tubular blank 34 with the end seals 32 by bringing the end seals 32 in contact with the axial ends of the tubular blank 34. The method includes the step of introducing hydraulic fluid into an interior of the tubular blank 34 under pressure and filling the interior of the tubular blank 34 with the fluid as illustrated in FIG. 2.

Figure 3:
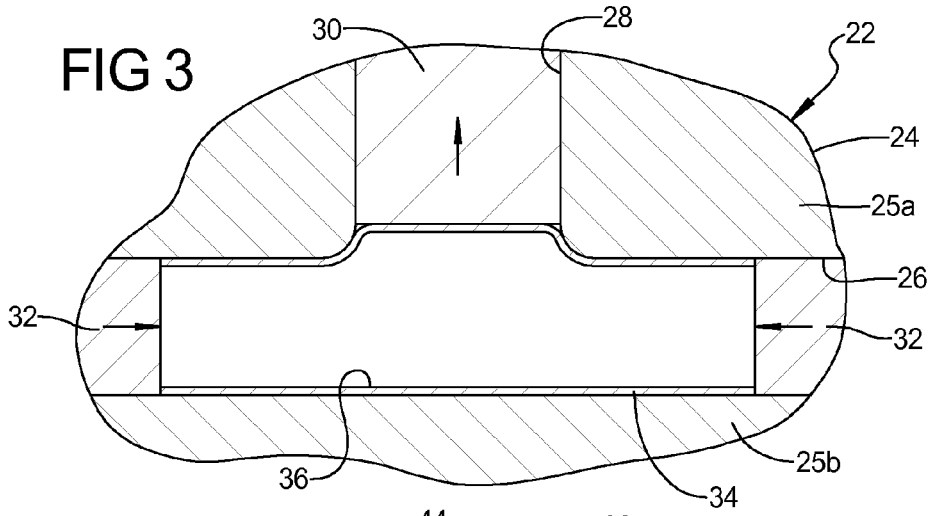
FIG. 3 is a view similar to FIG. 2 illustrating a first step of a method, according to the present invention, for hydroforming the hydroformed tubular member of FIG. 1.

The method also includes the step of increasing the fluid pressure in the tubular blank 34 and moving the end seals 32 toward each other and compressing the tubular blank 34 axially. The method includes the step of moving the piston 30 away from the first cavity 26 and allowing the wall 36 of the tubular blank 34 to bulge or expand into the second cavity 28 against the piston 30 as illustrated in FIG. 3. It should be appreciated that the hydroforming process proceeds by progressively increasing the internal fluid pressure in the tubular blank 34 while the end seals 32 are pushed toward one another, compressing the tubular blank 34 axially. It should also be appreciated that concurrent with the end seals 32 moving toward each other, the piston 30, which was initially flush with a wall of the first cavity 26, is progressively retracted to allow material of the wall 36 of the tubular blank 34 to bulge or expand into the piston 30.

Figure 4:
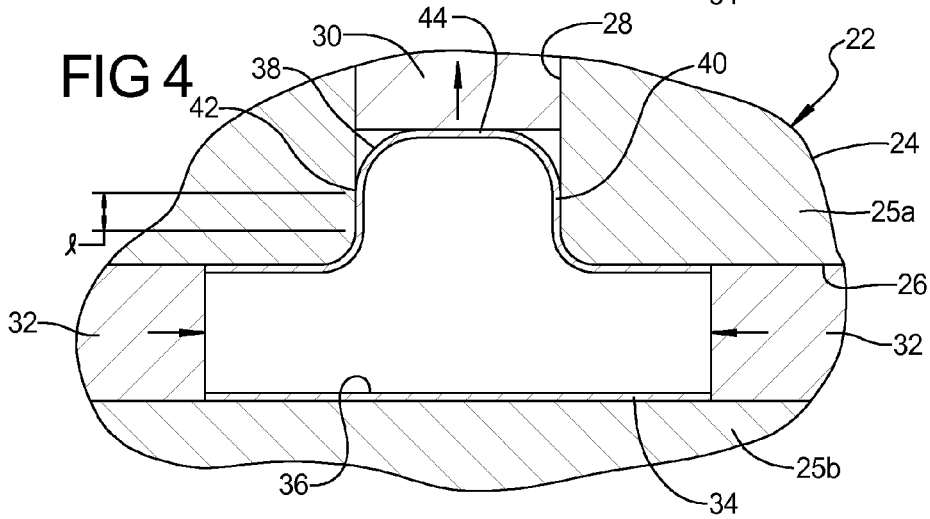
FIG. 4 is a view similar to FIG. 2 illustrating a second step of the method for hydroforming the hydroformed tubular member of FIG. 1.

The method also includes the step of moving the piston 30 further away from the first cavity 26 and forming a bulged portion or dome 38 to create a "T" shape as illustrated in FIG. 4. The dome 38 has a sidewall 40 with a portion 42 that is straight and of a length "l" in contact with the surface of the second cavity 28. The method further includes the step of maintaining the pressure in the tubular blank 34 and moving the piston 30 toward the first cavity 26. The method includes the step of flattening a top or end 44 of the dome 38 and forcing rounded shoulders 46 of the dome 38 to exhibit a smaller radius and bring additional material on the sides of the dome 38 in contact with the surface of the second cavity 28 as illustrated in FIG. 5. It should be appreciated that this step results in increasing a height of the straight portion 42 of the sidewall 40 of the dome 38 from a value of "l" to a value of "L" as illustrated in FIG. 1. It should also be appreciated that it may be necessary to increase the pressure in the tubular blank 34 before reversing the motion of the piston 30 so that friction between sides of the dome 38 and the second cavity 28 is increased and sliding of the sides of the dome 38 does not occur.

The method also includes the step of opening the die halves 25*a* and 25*b* to permit removal of the finished or hydroformed tubular member 10 from the die halves 25*a* and 25*b*. The hydroformed tubular member 10 may be assembled into a vehicle body (not shown) or some other desired vehicle component. It should be appreciated that the resulting hydroformed tubular member 10 has the contour of the cavity portions 26 and 28 of the die 24. It should also be appreciated that the method increases the straight length of the sidewall 18 from a value of "l" to a value of "L".

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

The invention claimed is:

1. A method of making a hydroformed tubular member, said method comprising the steps of:

providing a tubular blank having a wall;

providing a die having a first die half and a second die half with a first cavity to receive the tubular blank and a second cavity generally perpendicular to and communicating with the first cavity;

disposing movable end seals in the first cavity and a movable piston in the second cavity;

disposing the tubular blank in the first cavity;

sealing the ends of the tubular blank with the end seals;

concurrently filling the tubular blank with pressurized fluid and moving the end seals toward each other and moving the piston away from the second cavity so that a part of the wall of the tubular blank bulges into the second cavity and forms a length of tubular side wall engaging the second cavity and a dome engaging the movable piston; and moving the piston toward the second cavity, to thereby flatten the dome on the tubular blank, and thereby increase the length of tubular side wall engaging the second cavity.

2. The method of claim 1 further comprising increasing the pressure of the pressurized fluid in the tubular blank during or prior to moving the piston toward the second cavity so that the movement of the piston does not push the length of the side wall in the second cavity back into the first cavity as the dome is being flattened.

* * * * *